United States Patent [19]

Motomura et al.

[11] Patent Number: 4,559,991

[45] Date of Patent: Dec. 24, 1985

[54] METHOD AND SYSTEM OF CONTROLLING INJECTION MOLDING MACHINES

[75] Inventors: Noriyuki Motomura; Hiroyuki Tsuboi, both of Zama; Sadayoshi Yamada, Ebina, all of Japan

[73] Assignee: Toshiba Kikai Kabushiki Kaisha, Tokyo, Japan

[21] Appl. No.: 500,450

[22] Filed: Jun. 2, 1983

[30] Foreign Application Priority Data

Jun. 3, 1982 [JP] Japan ..... 57-94084

[51] Int. Cl.[4] ..... B22D 17/32

[52] U.S. Cl. ..... 164/457; 164/155; 164/113

[58] Field of Search ..... 164/457, 155, 113, 312; 264/40.1, 40.5; 425/145, 150

[56] References Cited

FOREIGN PATENT DOCUMENTS 7710838 12/1978 France ..... 164/155

56-131062 10/1981 Japan ..... 164/312

900965 1/1982 U.S.S.R. ..... 164/155

*Primary Examiner*—Nicholas P. Godici

*Assistant Examiner*—Kenneth F. Berg

*Attorney, Agent, or Firm*—Cushman, Darby & Cushman

[57] ABSTRACT

In a method and system of controlling an injection molding machine in which molten metal in an injection cylinder is injected into a metal mold by an injection plunger operated by an oil pressure operator and in which pressurized oil is supplied to the oil pressure operator through adjustable valve means actuated by actuator means, various factors relating to an injection condition are measured and an injection command signal is calculated based on the measured factors for providing a predetermined injection pattern. The actuator means is operated by the injection command signal so as to adjust the adjustable valve means to a degree of opening necessary to establish an optimum injection condition.

7 Claims, 3 Drawing Figures

METHOD AND SYSTEM OF CONTROLLING INJECTION MOLDING MACHINES

BACKGROUND OF THE INVENTION

This invention relates to a method and system of controlling an injection molding machine, and more particularly to a method and system of automatically controlling an injection condition at the time of pouring molten metal into a metal mold of such an injection molding machine as a die cast machine or the like for the purpose of always obtaining cast products having uniform and excellent quality.

In order to obtain cast products of uniform quality with an injection molding machine, for example, a die cast machine, it is essential to adequately set injection conditions such as the injection speed of the injection molding machine. Accordingly, in prior art injection molding machines, the operator determines the injection speed by relying upon measuring instruments or his feeling and manually adjusts the degree of opening of an injection valve so as to make it correspond to the injection speed thus determined. More particularly, according to the prior art method, the degree of opening of the injection valve is set to a predetermined value such that the low injection speed, high injection speed and pressure build-up time will not vary so as to stabilize the injection or molding conditions. However, the nonuniformities of the low injection speed, high injection speed and pressure build-up time are caused by variations in the molten metal temperature, metal mold temperature, operating oil temperature, accumulator pressure, etc. so that it has been difficult to always obtain molded or cast products of excellent quality. Although it has been tried to maintain these variable factors at constant values, such efforts have failed because it has been difficult to control these factors at a high response speed.

We have found that these difficulties can be overcome by noting the fact that molding or injection conditions necessary to obtain satisfactory products involve factors relating to the product including its thickness, weight, material, configuration, and field of application; factors relating to the mold including thickness of the stationary mold, the length of a sprue, gate area, mold temperature, injection cylinder diameter, etc.; machine factor regarding stroke, amount of projection, accumulator pressure; and other factors including cooling water temperature, operating oil temperature, mold release agent, etc. By using all of these factors for setting the injection condition, by constantly supervising or measuring specific factors that vary during the injection operation and by calculating an optimum injection condition based on data regarding these variable factors, the injection condition can be automatically adjusted to an optimum condition.

Among the variable factors that determine the injection condition, the product factor becomes a fixed factor by specifying the product. Then the variable factors are represented by the molten metal temperature, accumulator pressure, metal mold temperature, and operating oil temperature. Accordingly, an optimum injection condition can readily be set by constantly supervising at least these varying factors and by inputting data thereof into a computer.

SUMMARY OF THE INVENTION

Accordingly, it is the principal object of this invention to obtain a novel method and system of controlling the injection condition of an injection molding machine capable of obtaining cast products having uniform and excellent quality.

Another object of this invention is to provide a novel method and system of controlling the injection condition of an injection molding machine that can always establish an optimum injection condition with a computer of relatively simple construction.

According to one aspect of this invention, there is provided a method of adjusting the injection condition of an injection molding machine in which molten metal in an injection cylinder is injected into a metal mold by an injection plunger operated by an oil pressure operator and in which pressurized oil is supplied to the oil pressure operator through adjustable valve means actuated by actuator means. The method comprises the steps of measuring various factors relating to the injection condition, calculating an injection command signal based on measured factors for providing a predetermined injection pattern, and operating the actuator means in accordance with the injection command signal so as to adjust the adjustable valve means to a degree of opening necessary to establish an optimum injection condition.

According to another aspect of this invention, there is provided a system of controlling an injection molding machine of the type wherein molten metal in an injection cylinder is injected into a metal mold by an injection plunger operated by an oil pressure operator and in which pressurized oil is supplied to the oil pressure actuator through adjustable valve means actuated by actuator means. The system comprises measuring means for measuring various factors relating to an injection condition of the injection molding machine, means for calculating an injection command signal based on measured factors to provide a predetermined injection pattern and; means for operating the actuator means in accordance with the injection command signal so as to adjust the adjustable valve means to a degree of opening necessary to establish an optimum injection condition.

DESCRIPTION OF THE PREFERRED EMBODIMENT

Figure 1:
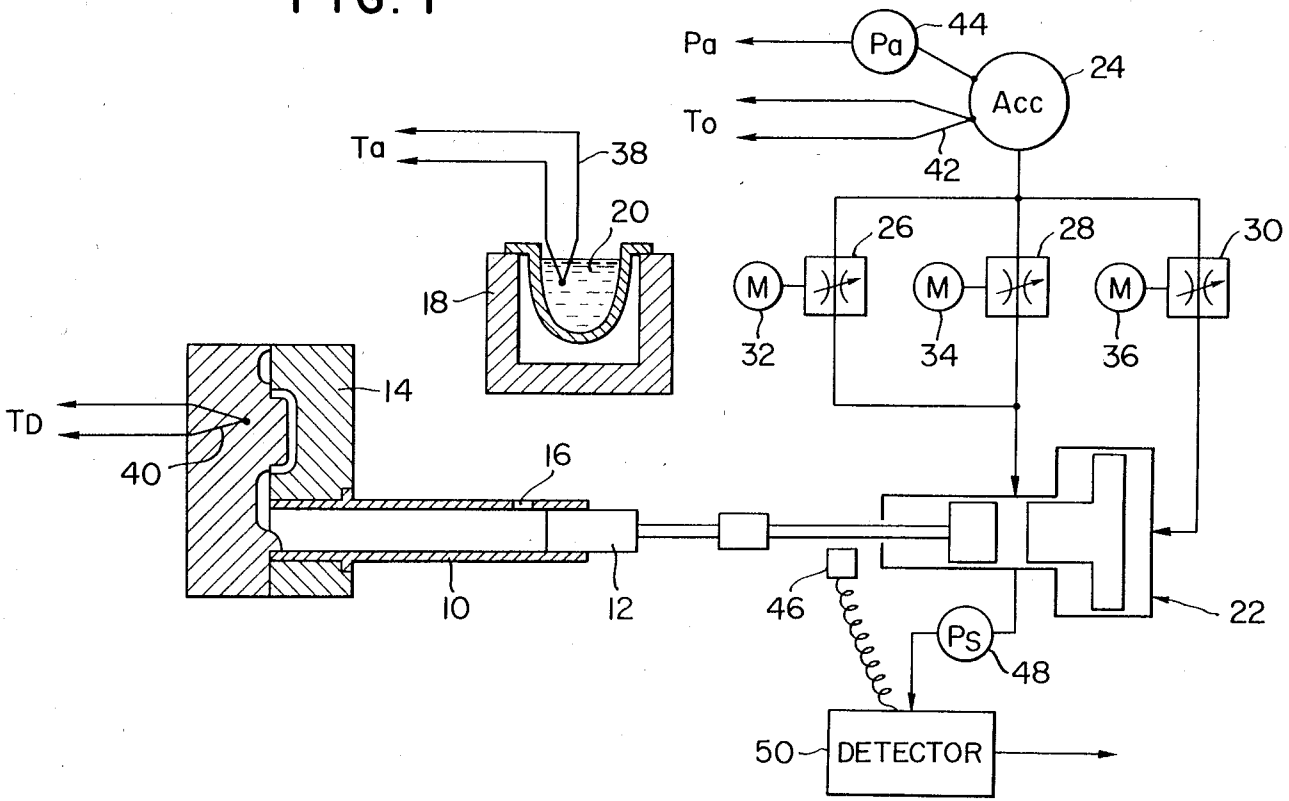
FIG. 1 shows a basic construction of an injection molding machine and its control elements to which the method of this invention is applicable.

FIG. 1 of the accompanying drawing shows the basic construction of an injection molding machine and its control elements. The injection molding machine comprises an injection cylinder 10 with one end connected to a metal mold 14, an injection plunger 12 to be inserted into injection cylinder 10. A molten metal pouring port 16 is formed near the other end of injection cylinder 10 to receive molten metal 20 prepared in a melting furnace 18. The injection plunger 12 is reciprocated by an oil pressure operator 22 of a well known construction and supply of pressurized oil to the operator 22 from an accumulator 24 is controlled by adjustable control valves 26, 28 and 30, the degree of opening thereof being controlled by actuators 32, 34 and 36, respectively. As would be apparent to one of ordinary skill in the art from viewing FIG. 1, the oil pressure actuator 22 for reciprocating injection plunger 12 includes a differential piston. Valve 26 is used to control the low speed of the injection cylinder while valve 28 is used to control the high speed of the injection cylinder. The valve 30 is used to control the oil pressure supplied to the actuator 22.

In the injection molding machine shown in FIG. 1, by adjusting the degree of opening of the values 26, 28, 30 with actuators 32, 34 and 36, it is possible to control the injection plunger 12 such that an injection speed and pressure build-up time suitable for the injection conditions of a predetermined cast product can be obtained.

According to this invention, the actuators 32, 34 and 36 for adjusting the degree of opening of the valves 26, 28 and 30 are operated by determining an optimum injection conditon by taking into consideration the following various factors.

The factors that determine the casting or molding condition are classified into the following four types:

(1) factors relating to the product . . . $\alpha_1, \alpha_2, \alpha_3, \ldots \alpha_i$ (wall thickness, weight, material shape, field of use, etc. of the product), (2) factors relating to the metal mold . . . $\beta_1, \beta_2, \beta_3, \ldots \beta_j$ (wall thickness of the stationary mold, length of a sprue, gate area, mold temperature, diameter of the injection cylinder, etc.), (3) factors relating to the molding machine . . . $\gamma_1, \gamma_2, \gamma_3, \ldots \gamma_k$ (injection stroke, extent of push out, accumulator pressure, etc.), and (4) other factors . . . $\delta_1, \delta_2, \delta_3, \ldots \delta_l$ (cooling water temperature, quantity of cooling water, operating oil temperature, molten metal temperature, mold release agent, etc.).

All of these factors are treated as functions of such injection conditions as a high injection speed $V_H$, a low injection speed $V_L$, a low speed stroke S, pressure build-up time $T_i$, as for example, shown in the following equation:

$$V_H, V_L, S, T_i = f(\alpha_1, \alpha_2, \alpha_3, \ldots \alpha_i; \beta_1, \beta_2, \beta_3, \ldots \beta_j; \gamma_1, \gamma_2, \gamma_3, \ldots \gamma_k; \delta_1, \delta_2, \delta_3, \ldots \delta_l)$$

Where the cast product is specified, among the factors that determine the injection condition, the factors relating to the product are fixed factors, whereas molten metal temperature $T_a$, accumulator pressure $P_a$, metal mold temperature $T_D$, operating oil temperature $T_o$ are variable factors and the remaining factors are all fixed data. Although the cooling water temperature, and the quantity of the cooling water are variable factors, since they can be represented by the metal mold temperature and the operating oil temperature they can be considered as fixed data. Denoting these fixed factors and fixed data by a coefficient k, the equation of functions that determine the injection condition can be shown as follows:

$$V_H, V_L, S, T_i = f(k, T_a, T_D, T_o, P_a)$$

Accordingly, according to this invention, variable factors acting as the functions determining the injection condition, i.e. molten metal temperature $T_a$, metal mold temperature $T_D$, operating oil temperature $T_o$ and accumulator pressure $P_a$ are constantly supervised or measured and the resulting data is used as the injection condition adjusting elements. Thus, as shown in FIG. 1, temperature sensors 38, 40 and 42 are provided, respectively, for the melting furnace 18, metal mold 14 and accumulator 24 and a pressure sensor 48 is provided for the accumulator 26. Data detected by these sensors 38–44 are sequentially subjected to arithmetic operation, as will be described in connection with FIG. 3, to automatically adjust the data for establishing the optimum injection condition. Thus, the oil pressure operator 22 is controlled through actuators 32, 34 and 36 and valves 26, 28 and 30 are operated thereby. The oil pressure operator 22 is provided with a position sensor 46 and a pressure sensor 48. Outputs of these sensors are detected by a detector 50 to provide a feedback control for the oil pressure operator 22.

Figure 2:
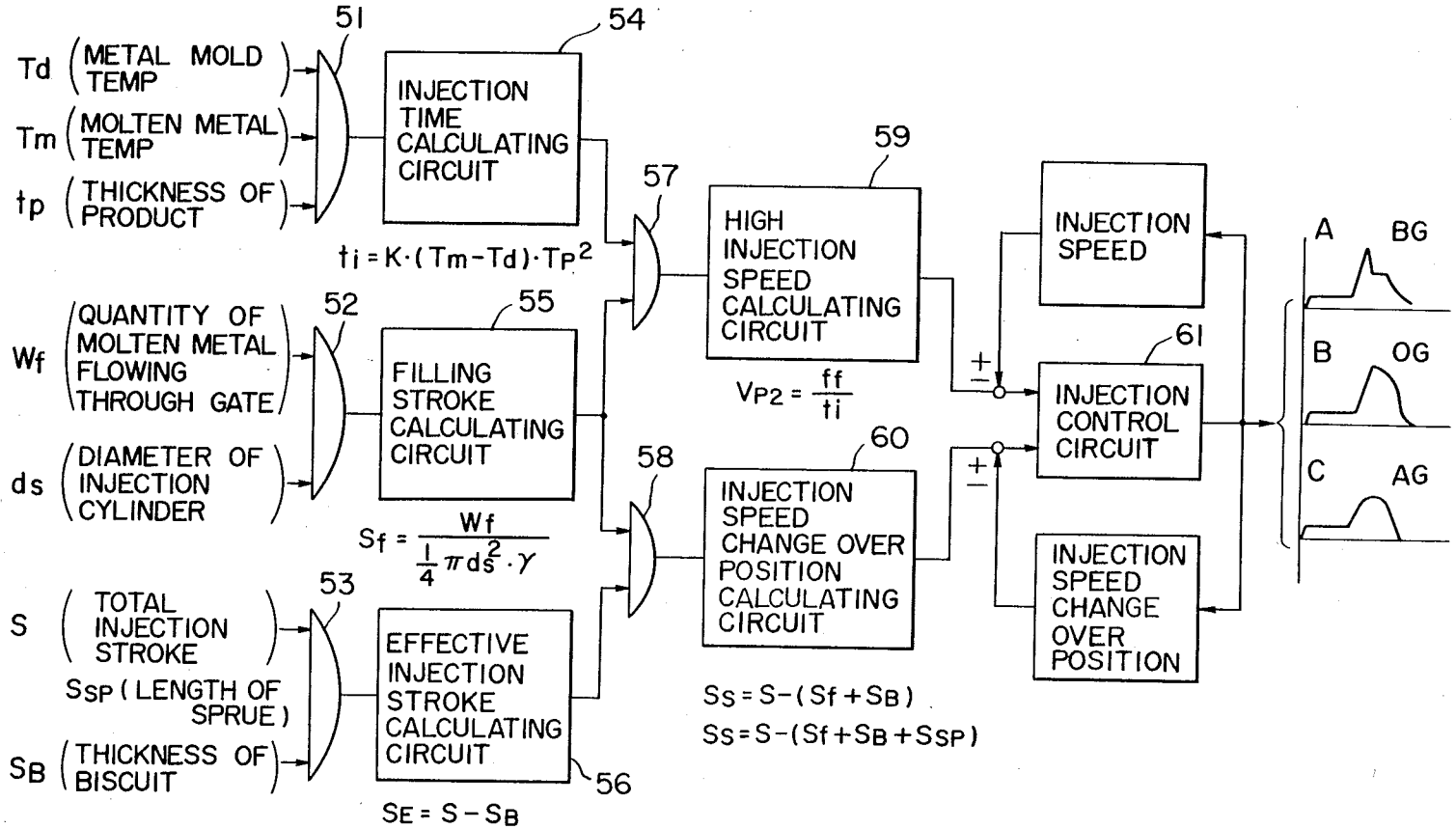
FIG. 2 is a block diagram showing the adjusting system of the preferred embodiment of this invention.

The injection speed is controlled by a circuit shown in FIG. 2. Thus signals $T_d$, $T_m$ and $T_p$, respectively, representing the metal mold temperature, molten metal temperature and thickness of the product are inputted to a first AND gate circuit 51, signals $W_f$ and $d_s$ respectively representing the quantity of the molten metal flowing through the gate and diameter of the injection cylinder are inputted to a second AND gate circuit 52, and signals S and $S_B$ respectively representing the total injection stroke and the thickness of a biscuit (a portion of the molten metal remaining at the front end of the injection cylinder without being injected into the mold) are inputted to a third AND gate circuit 53 to determine the effective injection stroke $S_E = S - S_B$ by effective injection stroke calculating circuit 56. In response to the output of the AND gate circuit 51, an injection time calculating circuit 54 (including a multiplier, a subtractor, a squaring circuit, etc.) calculates the injection time:

$$t_i = k \cdot (T_m - T_d) \cdot T_p^2$$

where k represents a constant.

In response to the output of the AND gate circuit 52, a filling stroke calculating circuit 55 (including a divider, a multiplier, a squaring circuit, etc.) calculates the filling stroke:

$$S_f = \frac{W_f}{\frac{1}{4}\pi d_s^2 \cdot \gamma}$$

where $\gamma$ represents the specific weight of the molten metal.

The outputs of the injection time calculating circuit 54 and the filling stroke calculating circuit 55 are inputted to a fourth AND gate circuit 57 and its output is applied to a high injection speed calculating circuit 59 including a divider for calculating the high injection speed:

$$V_{P2} = S_f / t_i$$

where $t_i$ represents the injection time.

The outputs of the filling stroke calculating circuit 55 and the effective injection stroke calculating circuit 56 are inputted to a fifth AND gate circuit 58, and the output thereof is applied to an injection speed change over position calculating circuit 60, which calculates the change over position $S_s$ at which the injection speed is changed over from low to high according to the following equation:

$$S_s = S - (S_f + S_B)$$

The outputs of the high injection speed calculating circuit 59 and the injection speed change over position calculating circuit 60 are applied to an injection control circuit 61 which produces either one of command signals A, B and C. Signals A, B and C control the injection plunger such that it produces injection patterns BG (before gate), OG (on gate) and AG (after gate) respectively having pattern configurations as shown at the right side in FIG. 2. Patterns BG and OG have the same peak injection speed but the peak injection speed of pattern AG is lower than those of the patterns BG and OG.

A portion of the output signal of the injection control circuit 61 is fed back to its input to correct or modify the injection speed and the injection speed change over position.

Where deep or cup shaped articles are to be cast, it is necessary to provide a projected sprue for the movable metal mold at a position opposing the injection end of the injection cylinder. In this case, a signal $S_{sp}$ representing the length of the sprue is also inputted to the third AND gate circuit 53 and the injection speed change over position calculating circuit 60 is so modified that it will produce a signal $S_s$ shown by an equation:

$$S_s = S - (S_f + S_B + S_{sp})$$

Figure 3:
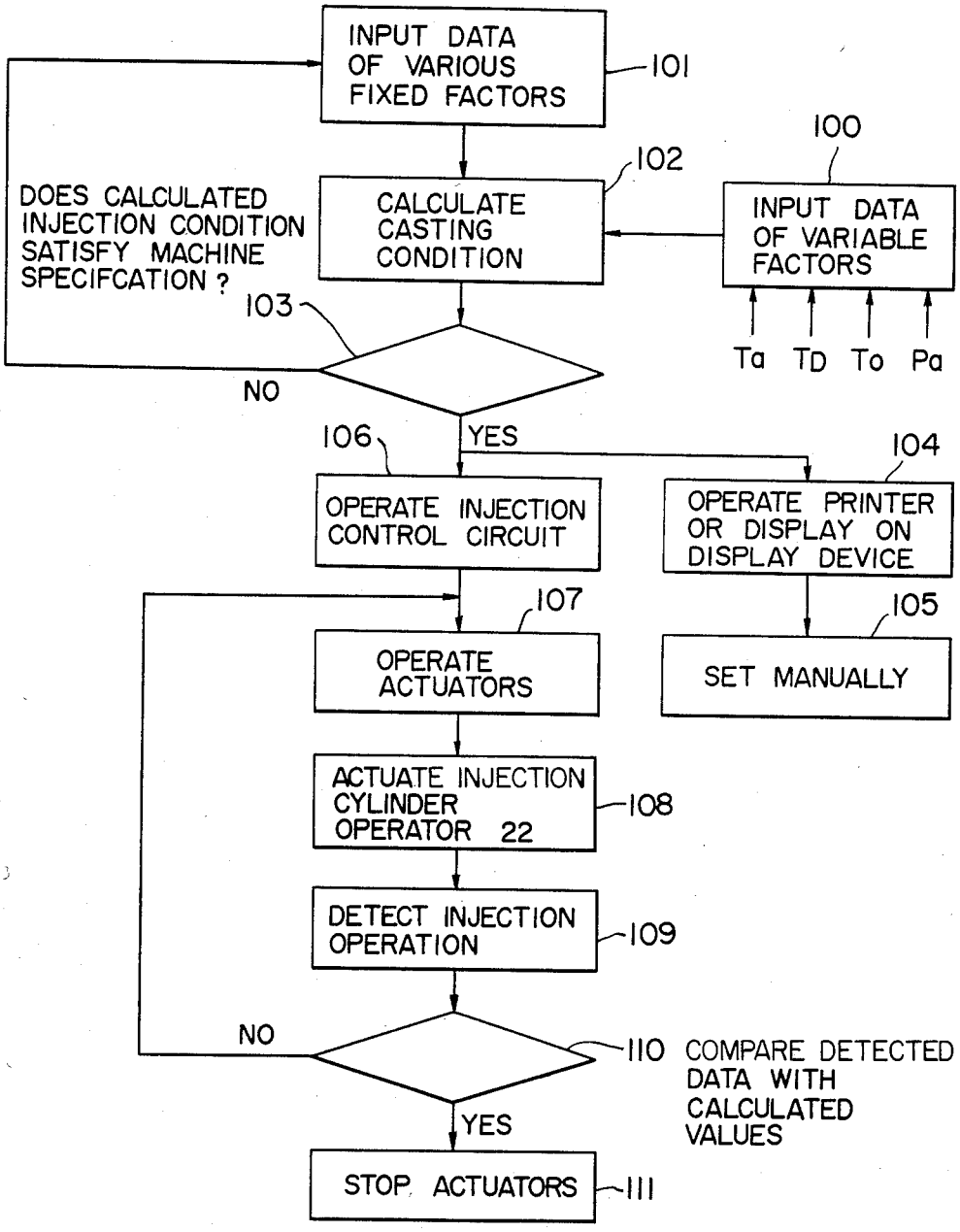
FIG. 3 is a flow chart for explaining the operation of the adjusting system shown in FIG. 2.

The method of automatically adjusting the injection condition necessary for setting an optimum casting condition for the injection molding machine shown in FIG. 1 will be described with reference to the flow chart shown in FIG. 3.

Among various factors that determine the injection condition, data regarding the fixed factors necessary to obtain satisfactory cast products are firstly determined and these data are inputted at step 101 to a computer, not shown, that calculates the optimum casting condition. Further, data regarding the variable factors, i.e. molten metal temperature $T_a$, metal mold temperature $T_D$, operating oil temperature $T_o$, and accumulator pressure $P_a$ are inputted to the computer at step 100. These data regarding the variable factors are detected by sensors shown in FIG. 1. Accordingly, at step 102 the computer calculates the fixed factors and the variable factors as the functions of the injection condition of the aforementioned equation so as to calculate high injection speed $V_H$, (low injection speed $V_L$, if necessary), injection speed change over position $S_s$ and pressure build-up time $T_i$ by the circuit shown in FIG. 2.

Then at step 103, a check is made as to whether the calculated injection condition satisfies the machine specification or not. If the result of check is YES, at step 106 the injection control circuit 61 is operated to operate various actuators 32, 34 and 36 to provide a commanded injection pattern BG, OG or AG. Furthermore, when the result of a check at step 103 is YES, at step 104 it is printed out or displayed on a display device. When the result of the check at step 103 is NO, the program is returned to step 101 as shown by the arrow in FIG. 3. According to the displayed result, the operator makes a manual setting, if necessary. As the actuators are operated, the degrees of opening of the valves 26, 28 and 30 are adjusted so as to actuate the operator 22 of the injection cylinder 10 to cast under the optimum condition at step 108. The injection operation is detected by detector 50 through position sensor 46 and pressure sensor 48 shown in FIG. 1. Then at step 110 the data thus detected are compared with the values calculated by the computer. If the difference is in a permissible range, the operations of actuators 32, 34 and 36 are stopped to retain the degrees of opening of the valves 26, 28 and 30 at the adjusted values. Otherwise, the degrees of opening of the valves 26, 28 and 30 are readjusted to bring back the difference into the permissible range.

As above described, according to this invention, since various fixed factors and factors that vary during the injection or casting operation necessary to obtain a specific product are used to calculate an optimum injection condition, casting can be made always under the optimum condition, whereby it is possible to continuously manufacture cast products of uniform and excellent quality.

Where the injection speed change over position is calculated based on the weight of the molten metal poured into the metal mold, that is the quantity of molten metal forming a riser and the volume of the mold cavity more efficient control can be made.

We claim:

1. A method of adjusting the injection condition of an injection molding machine in which molten metal in an injection cylinder is injected into a metal mold by an injection plunger operated by an oil pressure operator and in which pressurized oil supplied to said oil pressure operator is adjusted through adjustable valve means actuated by actuator means, said method comprising the steps of:

calculating an injection time, a filling stroke, and an effective stroke;

calculating a high injection speed based on said injection time and said filling stroke;

calculating an injection speed change over position based on said filling stroke and said effective injection stroke;

forming an injection command signal based on said calculated high injection speed and said calculated injection speed change over position; and applying said injection command signal to said actuator so as to set said adjustable valve means at an optimum injection condition.

2. The method according to claim 1 wherein said injection time $t_i$, said filling stroke $S_f$, said effective injection stroke $S_E$, said high injection speed $V_{p2}$ and said injection speed change over position $S_s$ are respectively calculated by the following equations:

$$t_i = K \cdot (T_m - T_d) \cdot T_p^2$$

$$S_f = \frac{W_f}{\frac{1}{4}\pi d_s^2 \cdot \gamma}$$

$$S_E = S - S_B$$

$$V_{p2} = \frac{S_f}{t_i}$$

$$S_s = S - (S_f + S_B) \text{ or } S_s = S - (S_f + S_B + S_{sp})$$

where

K: constant, $T_m$: temperature of molten metal $T_d$: temperature of metal mold $T_p$: thickness of cast product
$W_f$: quantity of molten metal flowing through a gate of a metal mold
$d_s$: diameter of injection cylinder
$\gamma$: specific weight of molten metal
S: total injection stroke
$S_B$: thickness of biscuit
$S_{sp}$: length of sprue 3. A system of controlling an injection molding machine of the type wherein molten metal in an injection cylinder is injected into a metal mold by an injection plunger operated by an oil pressure operator and in which pressurized oil is supplied to the oil pressure operator through adjustable valve means actuated by actuator means, said system comprising:

measuring means for measuring various factors relating to an injection condition of said injection molding machine;

means for calculating a high injection speed of said injection plunger based on said measured factors;

means for calculating an injection speed changeover position;

means for calculating an injection command signal based on said calculated injection speed and said calculated injection speed changeover position to provide a predetermined injection pattern; and means for operating said actuator means in accordance with said injection command signal so as to adjust said adjustable valve means to a degree of opening necessary to establish an optimum injection condition.

4. The system according to claim 3 wherein said measured factors include molten metal temperature, metal mold temperature, temperature of pressurized oil supplied to said oil pressure operator, and pressure of an oil accumulator supplying said pressurized oil to said oil pressure operator.

5. The system according to claim 3 wherein said calculating means comprises:

first means responsive to metal mold temperature, molten metal temperature, and thickness of a cast product for calculating an injection time;

second means responsive to a quantity of molten metal flowing through a gate of said metal mold and a diameter of said injection cylinder for calculating a filling stroke of said injection plunger;

third means responsive to a total injection stroke, and thickness of a biscuit formed at one end of said injection cylinder for calculating an effective injection stroke;

fourth means responsive to said injection time and said filling stroke for calculating a high injection speed;

fifth means responsive to said filling stroke and said effective injection stroke for calculating an injection speed change over position;

an injection control circuit responsive to said high injection speed and said injection speed change over position for producing a predetermined injection pattern signal; and means for applying said predetermined injection pattern signal to said actuator means so as to adjust said adjustable valve means to a degree of opening necessary to establish an optimum injection condition.

6. The system according to claim 5 which further comprising means for feeding back said predetermined injection pattern signal to an input terminal of said injection control circuit.

7. The system according to claim 3 wherein said third means further responds to the length of a sprue.

* * * * *